US008133129B2

(12) United States Patent
Boyd et al.

(10) Patent No.: US 8,133,129 B2
(45) Date of Patent: Mar. 13, 2012

(54) GOLF CLUB AND GOLF CLUB HEAD WITH INTERCHANGEABLE BODY COMPONENT

(75) Inventors: Robert Boyd, Euless, TX (US); Andrew G. V. Oldknow, Beaverton, OR (US); Chia-Chyi Cheng, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/827,524

(22) Filed: Jun. 30, 2010

(65) Prior Publication Data

US 2010/0304886 A1 Dec. 2, 2010

Related U.S. Application Data

(62) Division of application No. 12/124,426, filed on May 21, 2008, now abandoned.

(51) Int. Cl.
*A63B 53/06* (2006.01)

(52) U.S. Cl. ..... 473/288; 473/335; 473/334; 473/350

(58) Field of Classification Search ..... 473/288, 473/342, 334–335, 345–346, 350
See application file for complete search history.

(56) References Cited

U.S. PATENT DOCUMENTS

| | | | | |
|---|---|---|---|---|
| 1,253,700 | A | | 1/1918 | McLaughlin |
| 2,328,583 | A | | 9/1943 | Reach |
| 2,332,342 | A | | 10/1943 | Reach |
| 3,368,812 | A | * | 2/1968 | Baldwin, Sr. ..... 473/330 |
| 3,392,977 | A | | 7/1968 | De Lacey |
| 3,893,670 | A | | 7/1975 | Franchi |
| 4,121,832 | A | | 10/1978 | Ebbing |
| 4,506,888 | A | | 3/1985 | Nardozzi, Jr. |
| 4,540,178 | A | | 9/1985 | Johnson et al. |
| 4,708,347 | A | | 11/1987 | Kobayashi |
| 4,852,880 | A | * | 8/1989 | Kobayashi ..... 473/349 |
| 4,883,274 | A | | 11/1989 | Hsien |
| 4,884,808 | A | | 12/1989 | Retzer |
| 5,275,413 | A | | 1/1994 | Sprague |
| 5,297,794 | A | | 3/1994 | Lu |
| 5,332,214 | A | | 7/1994 | Tucker, Sr. |
| 5,407,196 | A | | 4/1995 | Busnardo |
| 5,437,447 | A | | 8/1995 | Rigutto |
| 5,439,223 | A | | 8/1995 | Kobayashi |
| 5,509,660 | A | | 4/1996 | Elmer |

(Continued)

FOREIGN PATENT DOCUMENTS

JP 51142455 U 11/1976

(Continued)

OTHER PUBLICATIONS

International Search Report and Written Opinion issued Oct. 14, 2009 in corresponding PCT No. PCT/US2009/044466.

*Primary Examiner* — Stephen L. Blau
(74) *Attorney, Agent, or Firm* — Banner & Witcoff, Ltd.

(57) ABSTRACT

An iron type golf club head includes a club head having a first body component defining a striking face, and a second body component releasably secured to the first body component with a fastener. The second body component defines at least a perimeter portion of a rear face of the club head body and may define substantially an entire rear face of the club head body.

34 Claims, 6 Drawing Sheets

U.S. PATENT DOCUMENTS

| | | | | |
|---|---|---|---|---|
| 5,536,011 | A * | 7/1996 | Gutowski | 473/350 |
| 5,584,770 | A * | 12/1996 | Jensen | 473/350 |
| 5,863,257 | A | 1/1999 | Busnardo | |
| 5,899,817 | A | 5/1999 | Dunikoski | |
| 5,911,638 | A | 6/1999 | Parente et al. | |
| 5,921,871 | A | 7/1999 | Fisher | |
| 6,015,354 | A | 1/2000 | Ahn et al. | |
| 6,206,790 | B1 | 3/2001 | Kubica et al. | |
| 6,238,303 | B1 * | 5/2001 | Fite | 473/342 |
| 6,478,694 | B2 | 11/2002 | Anderson et al. | |
| 6,569,029 | B1 * | 5/2003 | Hamburger | 473/238 |
| 6,659,883 | B2 | 12/2003 | Nelson et al. | |
| 6,663,502 | B2 | 12/2003 | Nelson et al. | |
| 6,695,714 | B1 | 2/2004 | Bliss et al. | |
| 6,773,361 | B1 | 8/2004 | Lee | |
| 6,863,620 | B2 | 3/2005 | Tucker, Sr. | |
| 7,101,290 | B2 | 9/2006 | Tucker, Sr. | |
| 7,108,611 | B2 * | 9/2006 | MacIlraith | 473/288 |
| 7,163,465 | B2 | 1/2007 | Edel | |
| 7,201,669 | B2 | 4/2007 | Stites et al. | |
| 7,207,900 | B2 | 4/2007 | Nicolette et al. | |
| 7,309,295 | B2 | 12/2007 | Solari | |
| 7,341,527 | B1 | 3/2008 | Fisher | |
| 7,396,296 | B2 * | 7/2008 | Evans | 473/344 |
| 7,431,662 | B2 * | 10/2008 | Tucker et al. | 473/288 |
| 2002/0098911 | A1 | 7/2002 | Nelson et al. | |
| 2003/0119601 | A1 | 6/2003 | Nelson et al. | |
| 2004/0132541 | A1 | 7/2004 | MacIlraith | |
| 2006/0148585 | A1 | 7/2006 | Vinton | |
| 2006/0166757 | A1 | 7/2006 | Butler, Jr. et al. | |
| 2006/0172816 | A1 | 8/2006 | Johnson | |
| 2006/0258480 | A1 | 11/2006 | Hou et al. | |
| 2007/0021236 | A1 * | 1/2007 | Tucker et al. | 473/340 |
| 2007/0111813 | A1 | 5/2007 | Edel | |
| 2007/0184915 | A1 | 8/2007 | Mansfield | |
| 2007/0207875 | A1 | 9/2007 | Kuan et al. | |
| 2007/0207876 | A1 | 9/2007 | Shende | |
| 2008/0020861 | A1 | 1/2008 | Adams et al. | |

FOREIGN PATENT DOCUMENTS

| | | | |
|---|---|---|---|
| JP | 60020261 | U | 2/1985 |
| JP | 06269521 | A | 9/1994 |

* cited by examiner

GOLF CLUB AND GOLF CLUB HEAD WITH INTERCHANGEABLE BODY COMPONENT

RELATED APPLICATION DATA

This application is a divisional of U.S. Ser. No. 12/124,426, filed May 21, 2008, and is entirely incorporated herein by reference.

FIELD OF THE INVENTION

This invention relates generally to golf clubs and golf club heads, and, in particular, to golf clubs and golf club heads having an interchangeable body component.

BACKGROUND OF THE INVENTION

Golfers tend to be sensitive to the "feel" of a golf club. The "feel" of a golf club comprises the combination of various component parts of the club and various features associated with the club that produce the sensory sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on various factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively.

Accordingly, club heads may be formed with various configurations to provide different performance characteristics and "feels." Additionally, club heads often have a cavity formed in its rear surface into which different weights can be placed to alter the performance characteristics and "feel" of the club.

It would be desirable to provide a golf club and golf club head that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a golf club and a golf club head having an interchangeable body component. In accordance with a first aspect, an iron type golf club head includes a club head having a first body component defining a striking face, and a second body component secured to the first body component with a fastener. The second body component defines at least a perimeter portion of a rear of the club head body and may define substantially an entire rear face of the club head body.

In accordance with another aspect, an iron type golf club head includes a club head having a first body component defining a striking face, and a second body component releasably secured to the first body component with a fastener. The second body component defines at least a perimeter portion of the rear face of the club head body and may define substantially an entire rear face of the club head body. A hosel is provided on one of the first body component and the second body component. The fastener may include a plurality of apertures extending through one of the first and second body components, a plurality of threaded recesses formed in the other of the first and second body components, and a plurality of threaded fasteners. Each threaded fastener is received in one of the threaded recesses.

In accordance with a further aspect, an iron type golf club head assembly includes a club head having a first body component defining a striking face, and a plurality of second body components. Each second body component is configured to be releasably secured to the first body component with a fastener. Each second body component defines at least a perimeter portion of a rear face of the club head body and may define substantially an entire rear face of the club head body when secured to the first body component and has at least one characteristic different than a characteristic of each other second body component.

In accordance with yet another aspect, an iron type golf club includes a club head having a first body component defining a striking face, and a second body component releasably secured to the first body component with a fastener. The second body component defines at least a perimeter portion of a rear face of the club head body and may define substantially an entire rear face of the club head body. A hosel is provided on one of the first body component and the second body component. A shaft member is engaged with the hosel.

Substantial advantage is achieved by providing an iron type golf club and an iron type golf club head having an interchangeable body component. In particular, certain embodiments allow a user (such as a club fitter, an individual player, etc.) to modify the performance characteristics and "feel" of the club by replacing a body component of the head with another body component having a different geometry, weight, weight distribution, and/or configuration.

These and additional features and advantages disclosed here will be further understood from the following detailed disclosure of certain embodiments.

Figure 1:
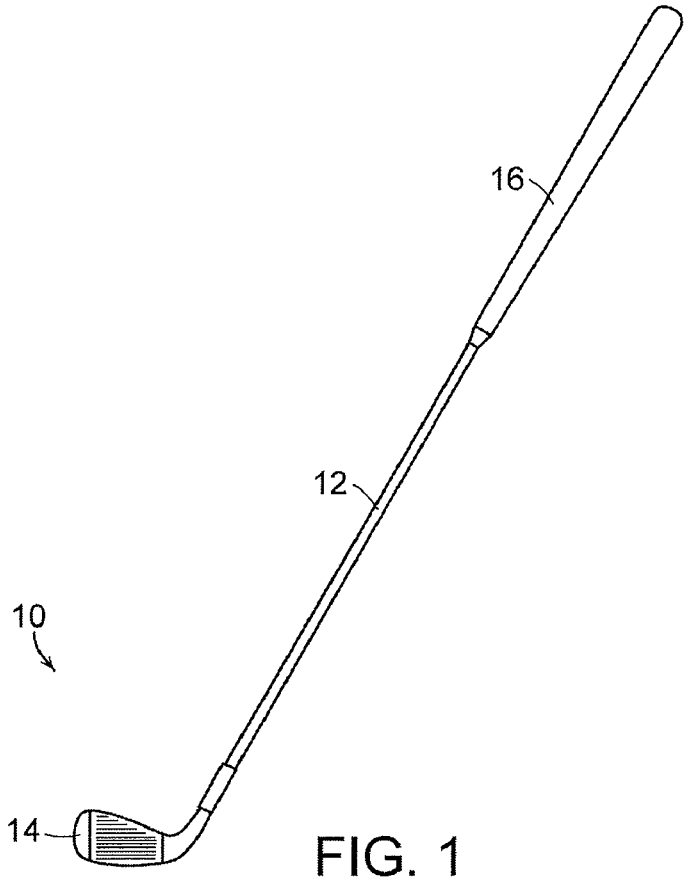
FIG. 1 is a perspective view of an embodiment of a golf club.

The figures referred to above are not drawn necessarily to scale, should be understood to provide a representation of particular embodiments of the invention, and are merely conceptual in nature and illustrative of the principles involved. Some features of the golf club and golf club head having an interchangeable body component depicted in the drawings have been enlarged or distorted relative to others to facilitate explanation and understanding. The same reference numbers are used in the drawings for similar or identical components and features shown in various alternative embodiments. Golf clubs and golf club heads having an interchangeable body component as disclosed herein would have configurations and components determined, in part, by the intended application and environment in which they are used.

DETAILED DESCRIPTION OF CERTAIN PREFERRED EMBODIMENTS

An embodiment of a golf club 10 is shown in FIG. 1 and includes a shaft 12 and a golf club head 14 attached to shaft 12. Golf club head 14 may be any iron or an iron type hybrid golf club head, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Figure 2:
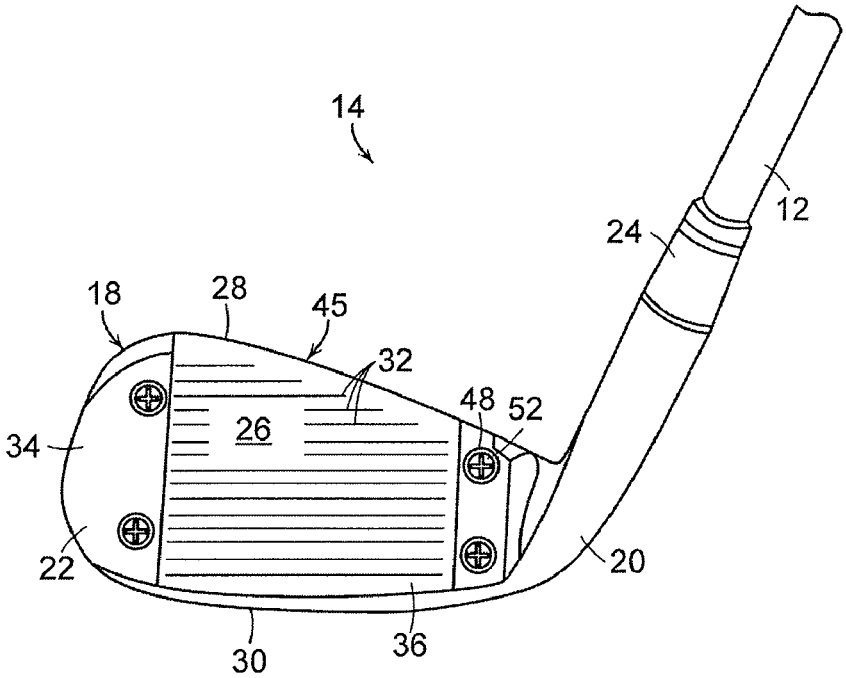
FIG. 2 is a front view of the head of the golf club of FIG. 1 according to this invention.

FIG. 2 illustrates golf club head 14 in more detail. As illustrated, this example golf club head 14 includes a body member 18 having a heel portion 20 and a toe portion 22. The heel portion 20 is attached to and/or extends from a hosel 24 (e.g., as a unitary or integral one piece construction, as separate connected elements, etc.) for connecting the shaft 12 to the golf club head 14. The body member 18 also includes a top portion 28 and a sole portion 30. A striking face 26 is provided between the top portion 28 and the sole portion 30, and between the toe 22 and the heel 20. The striking face 26 provides a contact area for engaging and propelling a golf ball in an intended direction. The striking face 26 may include grooves 32 (e.g., generally horizontal grooves 32 extending across the face 26 in the illustrated example) for the removal of water and/or grass from the striking face 26 during a ball strike. Any number of grooves, desired groove patterns, and/or groove constructions may be provided (or even no grooves, if desired), including conventional groove patterns and/or constructions as are known and used in the art.

Figure 3:
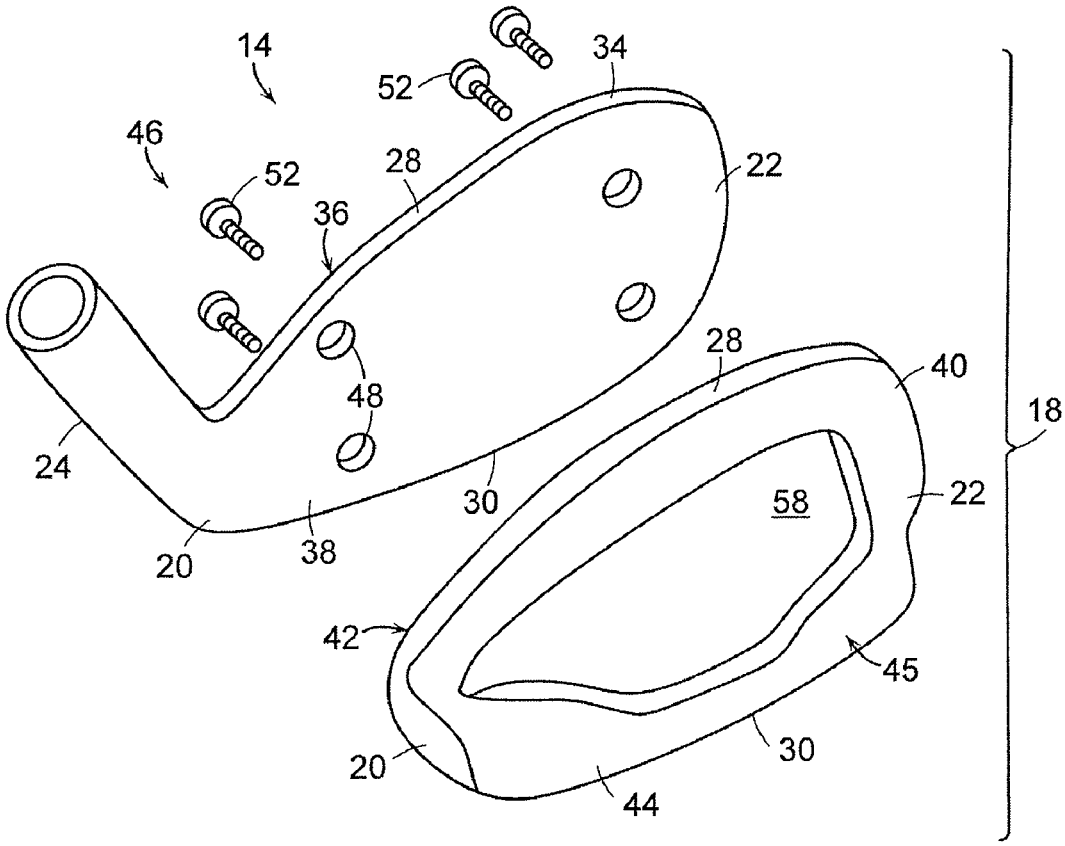
FIG. 3 is an exploded rear perspective view of the head of the golf club of FIG. 1.

As seen in FIG. 3, body 18 of golf club head 14 is formed of a first body component 34 having a front surface 36 that defines striking face 26, and a rear surface 38 that is opposite front surface 36. A second body component 40 of golf club head 14 is removably secured to first body component 34, and includes a front surface 42 that abuts rear surface 38 of first body component 34 when golf club head 14 is assembled, and a rear surface 44 that is opposite front surface 42. Rear surface 44 defines substantially the entire rear face 45 of golf club head 14. That is, when golf club head 14 is viewed from the rear, substantially the entire visible portion of head 14, that is, its rear face 45, is defined by second body component 40, and, more specifically, the rear surface 44 of second body component 40. In other words, the cavity 58 is closed. Alternatively, if desired, the second body component 40 may include only a perimeter weighting portion (e.g., formed as a ring), such that the rear surface 38 of the first body component 34 is exposed through an opening provided through the cavity 58 (i.e., the cavity 58 in the second body component 40 may be open).

Body member 18 of golf club head 14 may be constructed from a wide variety of different materials, including materials conventionally known and used in the art, such as steel, titanium, aluminum, magnesium, nickel, tungsten, alloys of these metals, graphite, polymers, fiber-reinforced materials, or composites, or combinations thereof. Other suitable materials will become readily apparent to those skilled in the art, given the benefit of this disclosure. It is to be appreciated that first body component 34 and second body component 40 may be formed of the same or different material.

Figure 4:
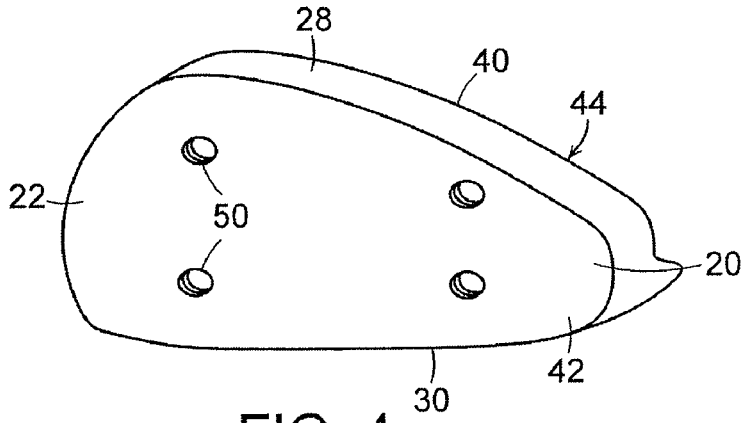
FIG. 4 is a perspective front view of the second body component of the head of the golf club of FIG. 3.

First body component 34 and second body component 40 are removably secured to one another with a fastener arrangement 46, as illustrated in FIGS. 3-4. The use of fastener 46 to removably secure second body component 40 to first body component 34 allows a user to remove second body component 40, and replace it with another second body component having one or more characteristics, e.g., performance characteristics, that are different than those of the initial second body component 40, thereby providing a golf club and/or a golf club head with an interchangeable body component.

In the embodiment illustrated in FIGS. 3-4, fastener 46 includes a plurality of apertures 48 extending through first body component 34, a plurality of threaded recesses 50 formed in front surface 42 of second body component 40, and a plurality of threaded fasteners 52. Each threaded fastener 52 is inserted through a corresponding aperture 48 in first body component 34 and threaded into a corresponding threaded recess 50 in second body component 40, thereby firmly securing first and second body components 34, 40 to one another. In this embodiment, as seen in FIG. 2, the heads of fasteners 52 are visible on front surface 36 of first body component 34. Threaded fasteners 52 are illustrated here as screws, but it is to be appreciated that they may be bolts (e.g., bolts with hex key type heads) or any other threaded fastener. If desired, cover or cap elements may be provided so that the fastener heads are not exposed or visible from the front surface 36 of the first body component 34.

Figure 5:
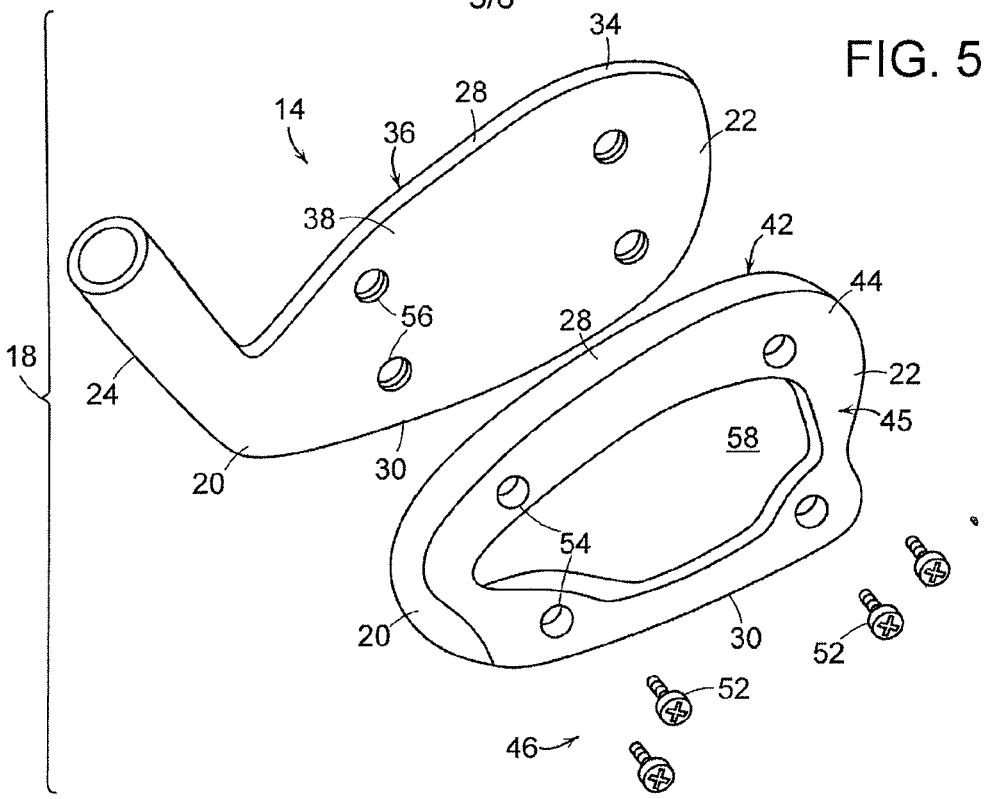
FIG. 5 is an exploded rear perspective view of an alternative embodiment of the head of the golf club of FIG. 1.

Another embodiment of a fastener 46 used to secure first body component 34 and second body component 40 to one another is illustrated in FIG. 5. In this embodiment, a plurality of apertures 54 extend through second body component, and a plurality of threaded apertures 56 are formed in rear surface 38 of first body component 34. In this embodiment, fasteners 52 are visible on rear surface 44 of second body component 40 and, naturally, rear face 45 of club head 14 when first and second body components 34, 40 are secured with fastener 46. Again, if desired, cover or cap elements may be provided so that the fastener heads are not exposed or visible from the rear surface 44 of the second body component 40.

Figure 6:
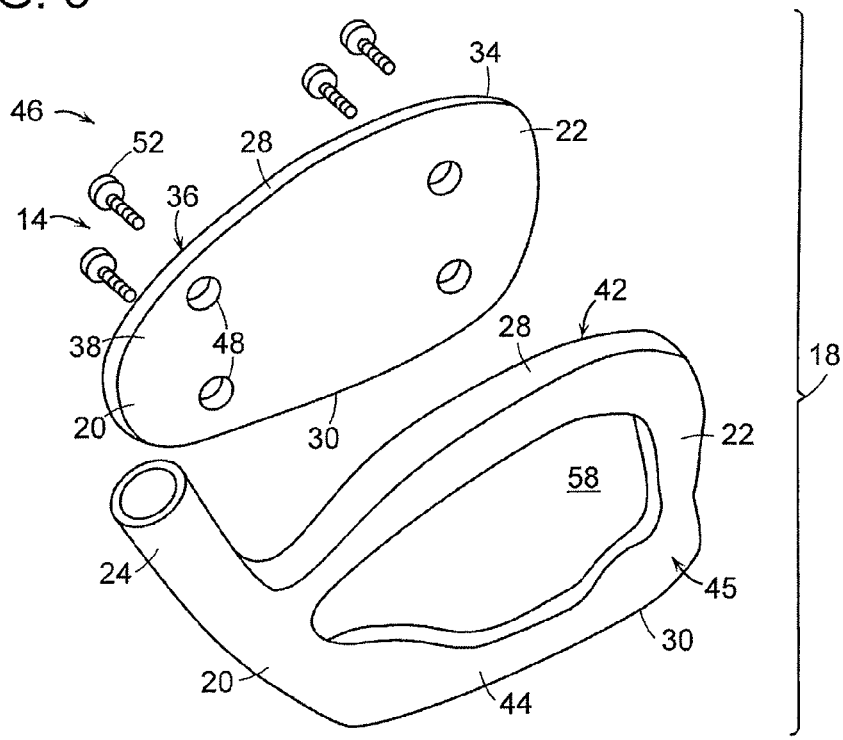
FIG. 6 is an exploded rear perspective view of another alternative embodiment of the head of the golf club of FIG. 1.

Another embodiment of club head 14 is illustrated in FIG. 6, in which hosel 24 extends from heel portion 20 of second body component 40 rather than from first body component 34 as illustrated FIGS. 3 and 5. In certain embodiments, hosel 24 could be formed of two separate pieces (not shown), with each of first body component 34 and second body component 40 including a portion of hosel 24.

As noted above, because second body component 40 is removably secured to first body component 34, second body component 40 can advantageously, easily, and quickly be replaced with a different second body component having one or more different characteristics than those of the initial second body component 40. Specifically, second body component 40 can be replaced with a new second body component having a different shape or geometry than that of initial second body component 40. Through the use of such interchangeable body components, golf club head 14 can be modified to produce a club head with different performance characteristics.

As seen in the embodiments illustrated in FIGS. 3 and 5, second body component 40 includes a cavity 58 formed in a central area of rear surface 44 such that club head 14 is what is known as a cavity backed, or perimeter weighted club head. Such a club head distributes the weight of the head around the perimeter of the head, thereby creating a more forgiving golf club head for the golfer.

Figure 7:
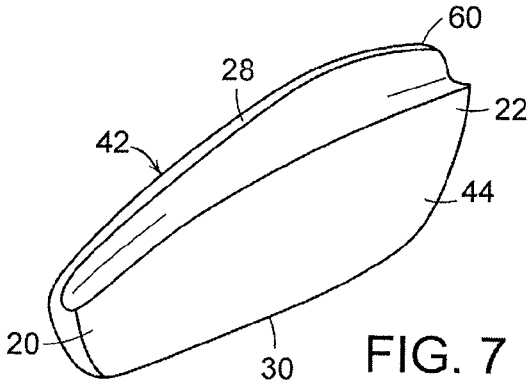
FIG. 7 is a perspective rear view of an alternative embodiment of the second body component of the head of the golf club of FIG. 3.

An alternative embodiment of a second body component 60 is illustrated in FIG. 7. Second body component 60 has a configuration known as a "blade" or a "muscle back" club, and contrary to that of a cavity back, or perimeter weighted head, does not include a cavity in its rear surface 44. A blade club head concentrates its weight about the center of the club head. Second body component 60 may be secured to first body component 34 in the same manner as discussed above, that is, with a suitable fastener arrangement 46. If desired, a user could convert a perimeter weighted rear body component 40 for a blade type body component 60 on the same front body component 34.

Figure 8:
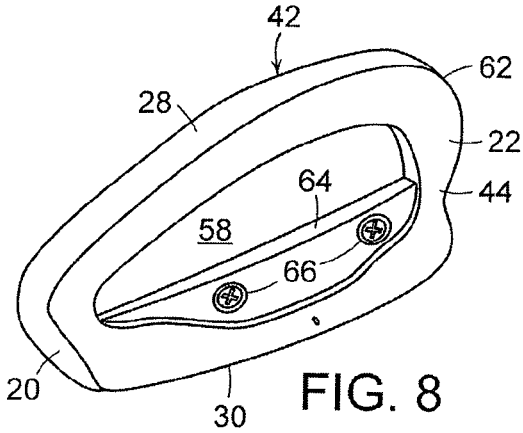
FIG. 8 is a perspective rear view of a further alternative embodiment of the second body component of the head of the golf club of FIG. 3, shown with a weight secured within a cavity in a rear surface of the second body component.

Another alternative embodiment of a second body component 62 is illustrated in FIG. 8. Second body component 62 is a cavity backed club head, with a cavity 58 formed in its rear surface 44. A weight 64 is secured within cavity 58 with a suitable fastener arrangement 66. As illustrated here, fastener 66 includes a pair of screws extending through apertures in weight 64 and received in threaded recess formed in second body component 62. It is to be appreciated that the performance of club head 14 can also be altered by replacing weight 64 with a different sized weight and/or a weight with a different weight distribution (e.g., a heel biased weight, a toe biased weight, a taller weight, a shorter weight, etc.

Figure 9:
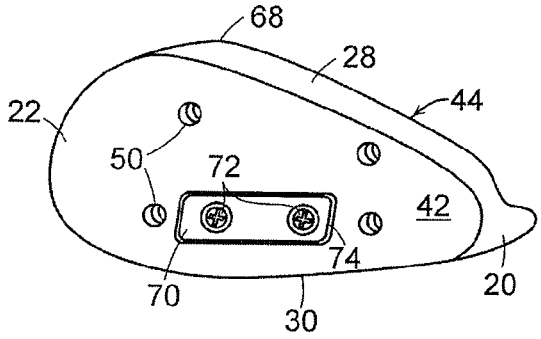
FIG. 9 is a perspective front view of another alternative embodiment of the second body component of the head of the golf club of FIG. 3, shown with a weight secured within a cavity in a front surface of the second body component.

A further alternative embodiment of a second body component 68 is illustrated in FIG. 9. Second body component 68 includes a weight 70 secured by a suitable fastener 72 within a recess or cavity 74 formed in front surface 42 of second body component 68. As illustrated here, fastener 72 includes a pair of screws extending through apertures in weight 70 and received in threaded recess formed in second body component 68. When mounted to a front body portion 34, this weight 70 would be concealed behind the golf club face. It is to be appreciated that the performance of club head 14 can also be altered by replacing weight 70 with a different sized weight and/or a weight with a different weight distribution, e.g., as described above.

Figure 10:
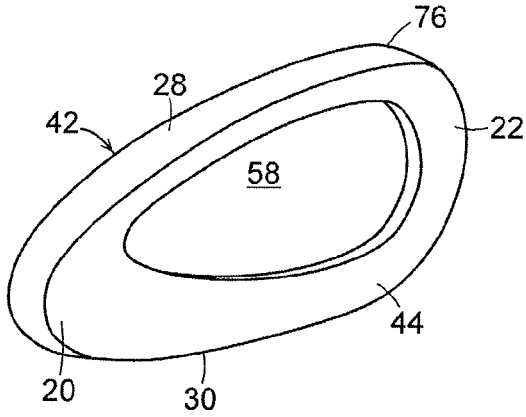
FIG. 10 is a perspective rear view of a further alternative embodiment of the second body component of the head of the golf club of FIG. 3.

Yet a further alternative embodiment of a second body component 76 is illustrated in FIG. 10. Second body component 76 is a cavity backed club head, with a cavity 58 formed in its rear surface 44. Second body component 76 is configured to provide a heel-weighted club head 14. A heel-weighted club is a club head that has a high concentration of its weight positioned toward the heel portion of the club head. Thus, as can be seen in FIG. 10, more material is found in the peripheral area outside of cavity 58 proximate heel portion 20, with cavity 58 being larger toward toe portion 22 and, naturally, less material is found in the peripheral area outside of cavity 58 proximate toe portion 22. Such a club head configuration provides the user with a better capability of inducing a draw in the flight of the golf ball (and/or compensates for swing faults that tend to produce a slicing ball flight).

Figure 11:
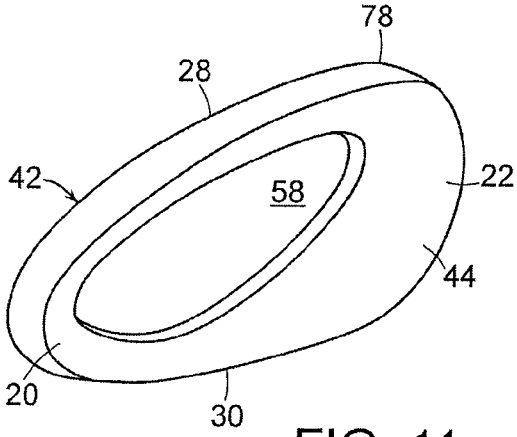
FIG. 11 is a perspective rear view of an alternative embodiment of the second body component of the head of the golf club of FIG. 3.

Another embodiment of a second body component 78 is illustrated in FIG. 11. Second body component 78 is also a cavity backed club head, with cavity 58 formed in its rear surface 44. However, in this embodiment, second body component 78 is configured to provide a toe-weighted club head 14. A toe-weighted club is a club head that has a high concentration of its weight positioned toward the toe portion of the club head. Thus, as can be seen in FIG. 11, more material is found in the peripheral area outside of cavity 58 proximate toe portion 22, with cavity 58 being larger toward heel portion 20 and, naturally, less material is found in the peripheral area outside of cavity 58 proximate heel portion 20. Such a club head configuration provides the user with a better capability of inducing a fade in the flight of the golf ball (and/or compensates for swing faults that tend to produce a hooking ball flight).

Thus it can be seen that any number of alternative second body components can be substituted for second body component 40. Accordingly, a user can have a variety of different second body components that can be substituted for one another for a variety of reasons. For example, a second body component can be selected based on playing conditions expected to be encountered (e.g., different course conditions, different weather conditions, different wind conditions, etc.), the type of golf ball being used, and the skill or ability of the golfer. As a user improves, they may adapt a different playing style, and being able to replace the second body component of the club head allows them to modify their club without purchasing an entirely new club. It is to be appreciated that all aspects of the geometry or mass properties of club head 14 can be modified through the use of the interchangeable body component including, but not limited to, the club head's shape, weight, weight distribution, bounce angle, center of gravity, moment of inertia, material of which it is formed, and appearance, which can alter the center of gravity, moment of inertia, and/or other "feel" characteristics of club head 14.

Such interchangeable body components, that is, additional second body components can be provided for each of the different clubs a golfer uses, allowing significant flexibility for the golfer. Alternatively, if desired, by exchanging first body components on a given second body component (optionally with the hosel element formed with the second body component), the user may alter the loft angle of the club (e.g., to change a wedge from a 48 degree wedge to a 52 degree wedge).

Figure 12:
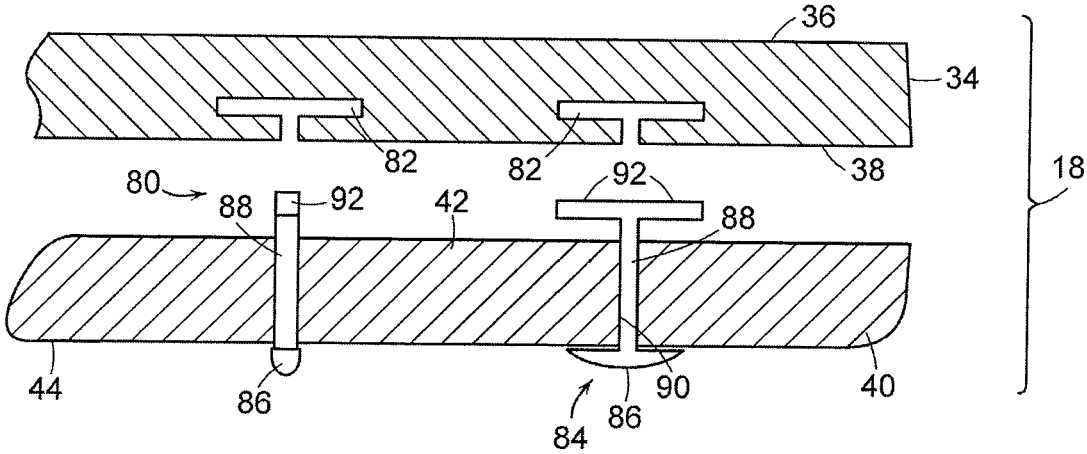
FIG. 12 is a section view of an alternative embodiment of a fastener for the golf club head of FIG. 3.

An alternative embodiment of a fastener 80 for golf club head 14 is illustrated in FIG. 12. Fastener 80 includes a pair of keyhole-shaped recesses 82 formed in rear surface 38 of first body component 34 and a pair of keys 84. Each key 84 has a handle portion 86 seated outward of rear surface 44 of second body component 40, a shaft portion 88 that extends from handle portion 86 at one end thereof, through an aperture 90 extending through second body component 40, and ends at a pair of arms 92 that extend transversely from the end of shaft portion 88. As illustrated in FIG. 12, the leftmost key 84 is shown in its position prior to insertion in a keyhole-shaped recess 82, while the rightmost key 84 is shown after being rotated to its closed or locked position. To secure second body component 40 to first body component 34, the arms 92 of keys 84 are inserted into a corresponding keyhole-shaped recesses 82 in the position illustrated by the leftmost key 84. Each key 84 is then turned 90° within its keyhole-shaped recess 82 to its closed or locked position illustrated by the rightmost key 84.

Figure 13:
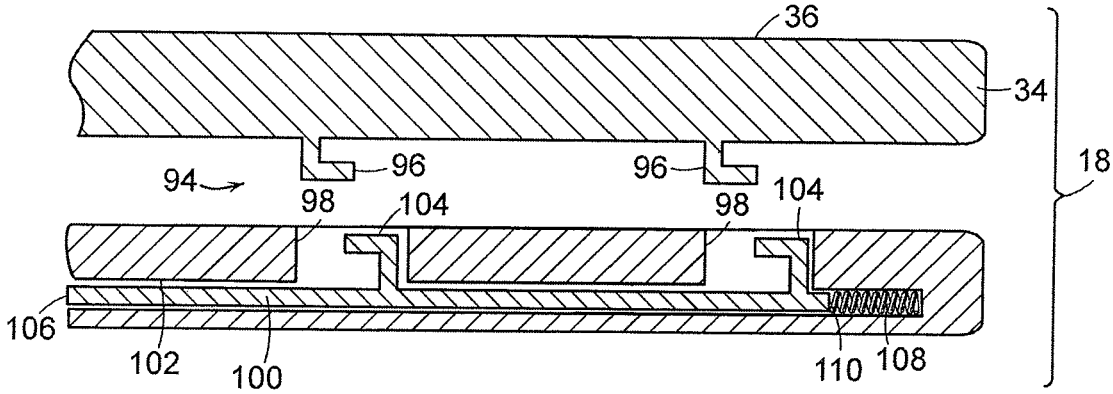
FIG. 13 is a section view of another alternative embodiment of a fastener for the golf club head of FIG. 3.

Another alternative embodiment of a fastener 94 is illustrated in FIG. 13. Fastener 94 includes a pair of substantially L-shaped arms 96 extending outwardly from rear surface 38 of first body component 34. Each arm 96 is received in a corresponding first recess 98 formed in front surface 42 of second body component 40. A rod 100 extends within a second recess 102 formed in second body component 40. Second recess 102 is in communication with first recesses 98. A pair of substantially L-shaped arms 104 is formed on rod 100, with each arm 104 being received in a corresponding first recess 98. Arms 104 of second body component 40 engage arms 96 of first body component 34 to secure first and second body components 34, 40 together. To release first and second body components 34, 40 from their engaged position, a first end 106 of rod 100, which may extend outwardly from second body component 40 (or may be engaged by inserting a tool into an opening provided in the second body component 40), is depressed against a spring 108 that is seated within second recess 102 and is biased against the second end 110 of rod 100. As shown in FIG. 13, rod 100 is in its depressed condition just prior to insertion of arms 96 of first body component 34 within first recesses 98.

As illustrated herein, it can be seen that there are many alternative engagement structures and fastener arrangements available for securing first and second body components 34, 40 together. As an additional example, dovetail or other types of joints may be provided to help securely hold the first and second body components 34, 40 together. Other suitable engagement and fastener arrangements will become readily apparent to those skilled in the art, given the benefit of this disclosure.

Figure 14:
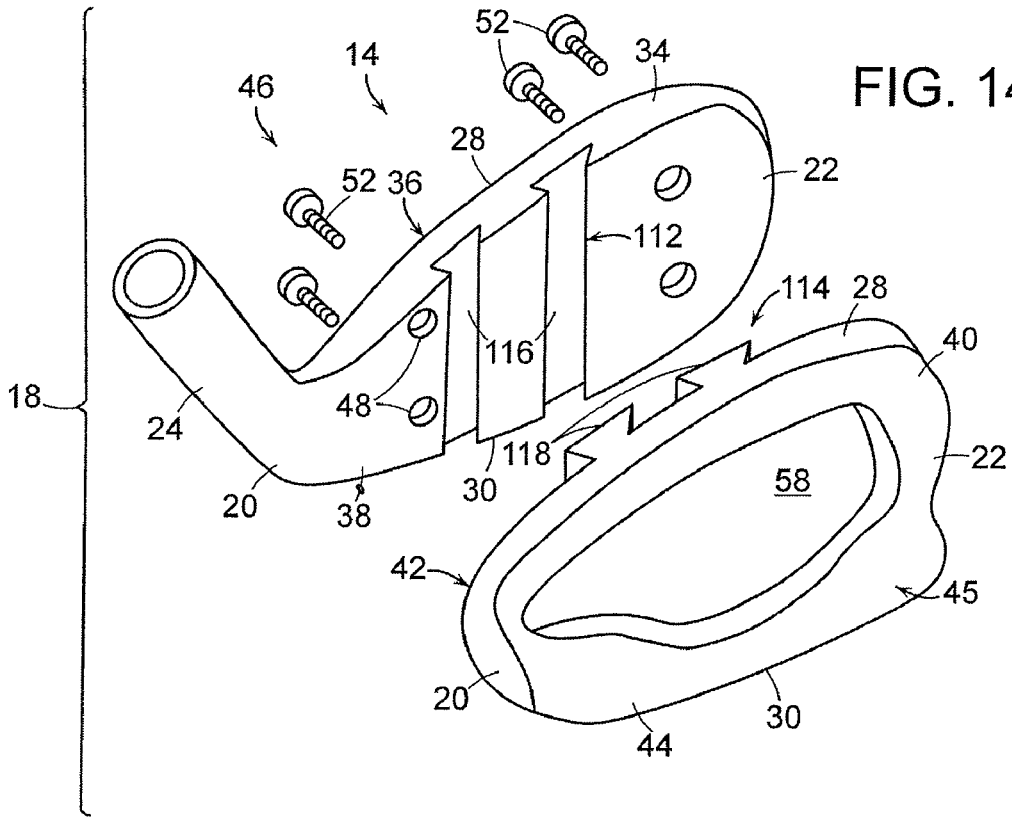
FIG. 14 is an exploded rear perspective view of the head of an alternative embodiment of a golf club.

An alternative embodiment is shown in FIG. 14, in which first body component 34 includes a first alignment member 112 and second body component 40 includes a second alignment member 114 that is configured to mate with first alignment member 112. In the embodiment illustrated in FIG. 14, first alignment member 112 and second alignment member comprise a dovetail joint, with first alignment member 112 being a pair of mortise slots 116 and second alignment member being a mating pair of tenons 118. It is to be appreciated that although a pair of mating mortise slots 116 and tenons 118 are shown here, any number of mating mortise slots 116 and tenons 118 could be used.

Further, it is to be appreciated that the mortise slots 116 could be formed on second body component 40 with the corresponding tenons 118 being formed on first body component 34. In other embodiments, the mortise slots and tenons could be mixed, with some mortise slots 116 formed on first body component 34 and others formed on second body component 40, and corresponding tenons 118 being formed on both first and second body component 34, 40.

The mating of first and second alignment members 112, 114 serves to align and register first body component 34 and second body component 40 with respect to one another, helping to ensure a rigid and accurate connection between them.

Figure 15:
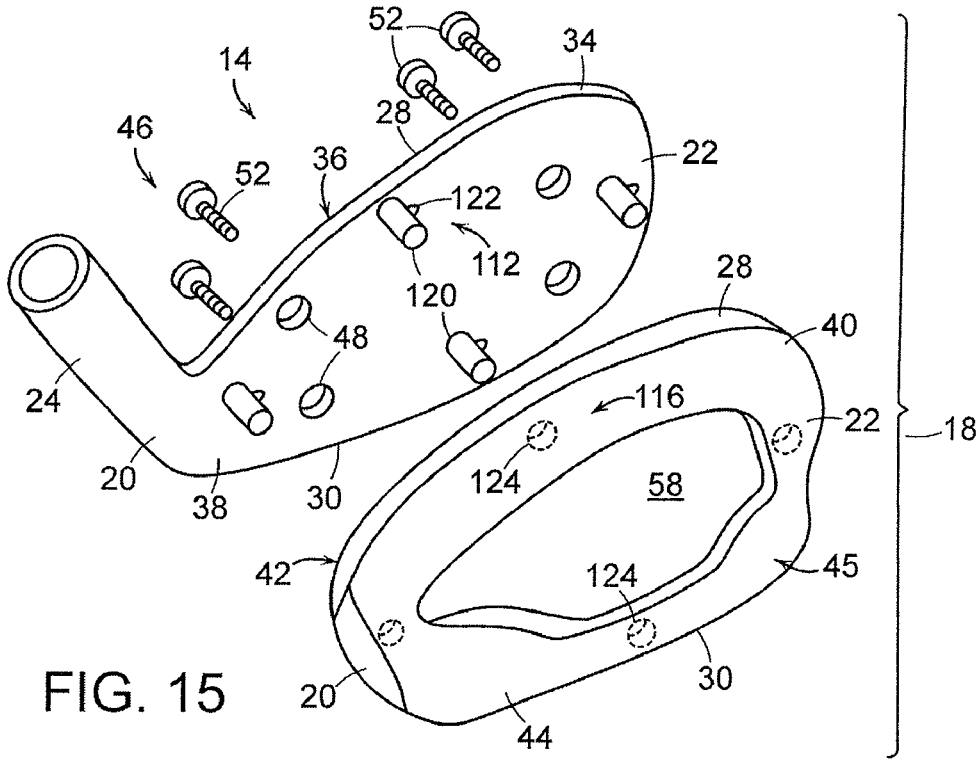
FIG. 15 is an exploded rear perspective view of the head of another alternative embodiment of a golf club.

Another embodiment is shown in FIG. 15, in which first and second body components 34, 40 include first and second alignment members 112, 116, respectively, that take the form of a quick connect assembly. In the illustrated embodiment, first alignment member 112 includes a plurality of projections 120, with each projection 120 including a spring-loaded detent 122 and is received in a recess 124 formed in front surface 42 of second body component 40. It is to be appreciated that first and second alignment members 112, 114 can take on any shape or form.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

The invention claimed is:

1. An iron type golf club head comprising:

a club head having a first body component defining a striking face and a first abutment face, and a second body component having a second abutment face and releasably secured to the first body component with a fastener such that the first and second abutment faces abut one another to define an abutment plane, wherein the second body component defines substantially an entire rear face of the club head, and the fastener includes a first non-threaded interlocking member and a second non-threaded interlocking member, the first and second interlocking members engaging one another to prevent the first and second body components from being separated from one another in a direction extending substantially perpendicular to the abutment plane;

wherein one of the first and second non-threaded interlocking members includes a recess formed in one of the first and second abutment faces.

2. The golf club head of claim 1, wherein the rear face of the second body component is cavity backed.

3. The golf club head of claim 1, wherein the first body component and the second body component define a blade head.

4. The golf club head of claim 1, wherein the second body component includes a cavity and a weight removably secured within the cavity.

5. The golf club head of claim 4, wherein the cavity is formed on the second abutment face of the second body component.

6. The golf club head of claim 1, further comprising at least one additional second body component configured to be releasably secured to the first body component.

7. The golf club head of claim 6, wherein the second body component has a first shape and the at least one additional second body component has a second shape that is different than the first shape.

8. The golf club head of claim 7, wherein the second body component has a first weight and the at least one additional second body component has a second weight that is different than the first weight.

9. The golf club head of claim 7, wherein the second body component has a first weight distribution characteristic and the at least one additional second body component has a second weight distribution characteristic that is different than the first weight distribution characteristic.

10. The golf club head of claim 7, wherein the second body component is formed of a first material and the at least one additional second body component is formed of a second material that is different than the first material.

11. The golf club head of claim 1, further comprising a hosel provided on the first body component.

12. The golf club head of claim 1, wherein the first body component includes a first alignment member and the second body component includes a second alignment member configured to mate with the first alignment member.

13. The iron type golf club head of claim 1, wherein the first non-threaded interlocking member comprises a pair of keyhole-shaped recesses formed in the first abutment face of the first body component; and the second non-threaded interlocking member comprises a pair of keys, each key extending through an aperture formed in the second body component and being received in a corresponding one of the keyhole-shaped recesses.

14. The iron type golf club head of claim 13, wherein each key includes a handle portion positioned outwardly of a rear surface of the second body component, a shaft extending through the aperture, and a pair of arms extending transversely from an end of the shaft.

15. The iron type golf club head of claim 1, wherein the first non-threaded interlocking member comprises a first pair of arms extending outwardly from the first abutment face of the first body component, the arms being received in a first recess formed in the second abutment face of the second body component; and the second non-threaded interlocking member comprises:

a rod extending within a second recess formed in the second body component, the second recess being in communication with the first recess;

a second pair of arms formed on the rod, the second arms releasably engaging the first arms; and a biasing member seated within the second recess and biasing an end of the rod such that the first and second pairs of arms are pressed into engagement with one another.

16. The iron type golf club head of claim 15, wherein the biasing member is a spring.

17. An iron type golf club head comprising:

a club head having a first body component defining a striking face and a first abutment face, and a second body component having a second abutment face and releasably secured to the first body component with a fastener such that the first and second abutment faces abut one another to define an abutment plane; and a hosel on one of the first body component and the second body component;

wherein the fastener comprises a first non-threaded interlocking member and a second non-threaded interlocking member, the first and second interlocking members engaging one another to prevent the first and second body components from being separated from one another in a direction extending substantially perpendicular to the abutment plane;

wherein one of the first and second non-threaded interlocking members includes a recess formed in one of the first and second abutment faces.

18. The golf club head of claim 17, further comprising at least one additional second body component configured to be releasably secured to the first body component.

19. The golf club head of claim 18, wherein the second body component has a first shape and the at least one additional second body component has a second shape that is different than the first shape.

20. The golf club head of claim 17, wherein the first body component includes a first alignment member and the second body component includes a second alignment member configured to mate with the first alignment member.

21. The iron type golf club head of claim 17, wherein the first non-threaded interlocking member comprises a pair of keyhole-shaped recesses formed in the first abutment face of the first body component; and the second non-threaded interlocking member comprises a pair of keys, each key extending through an aperture formed in the second body component and being received in a corresponding one of the keyhole-shaped recesses.

22. The iron type golf club head of claim 21, wherein each key includes a handle portion positioned outwardly of a rear surface of the second body component, a shaft extending through the aperture, and a pair of arms extending transversely from an end of the shaft.

23. The iron type golf club head of claim 17, wherein the first non-threaded interlocking member comprises a first pair of arms extending outwardly from the first abutment face of the first body component, the arms being received in a first recess formed in the second abutment face of the second body component; and the second non-threaded interlocking member comprises:

a rod extending within a second recess formed in the second body component, the second recess being in communication with the first recess;

a second pair of arms formed on the rod, the second arms releasably engaging the first arms; and a biasing member seated within the second recess and biasing an end of the rod such that the first and second pairs of arms are pressed into engagement with one another.

24. The iron type golf club head of claim 23, wherein the biasing member is a spring.

25. An iron type golf club comprising:

a club head having a first body component defining a striking face and a first abutment face, and a second body component having a second abutment face and releasably secured to the first body component with a fastener such that the first and second abutment faces abut one another to define an abutment plane, wherein the second body component defines substantially an entire rear face of the club head, and the fastener includes a first non-threaded interlocking member and a second non-threaded interlocking member, the first and second interlocking members engaging one another to prevent the first and second body components from being separated from one another in a direction extending substantially perpendicular to the abutment plane;

a hosel provided on one of the first body component and the second body component; and a shaft member engaged with the hosel;

wherein one of the first and second non-threaded interlocking members includes a recess formed in one of the first and second abutment faces.

26. The golf club of claim 25, further comprising at least one additional second body component configured to be releasably secured to the first body component.

27. The golf club of claim 26, wherein the second body component has a first shape and the at least one additional second body component has a second shape that is different than the first shape.

28. The golf club of claim 26, wherein the second body component has a first weight distribution characteristic and the at least one additional second body component has a second weight distribution characteristic that is different than the first weight distribution characteristic.

29. The golf club of claim 26, wherein the second body component has a first weight and the at least one additional second body component has a second weight that is different than the first weight.

30. The golf club head of claim 25, wherein the first body component includes a first alignment member and the second body component includes a second alignment member configured to mate with the first alignment member.

31. The iron type golf club of claim 25, wherein the first non-threaded interlocking member comprises a pair of keyhole-shaped recesses formed in the first abutment face of the first body component; and the second non-threaded interlocking member comprises a pair of keys, each key extending through an aperture formed in the second body component and being received in a corresponding one of the keyhole-shaped recesses.

32. The iron type golf club of claim 31, wherein each key includes a handle portion positioned outwardly of a rear surface of the second body component, a shaft extending through the aperture, and a pair of arms extending transversely from an end of the shaft.

33. The iron type golf club of claim 25, wherein the first non-threaded interlocking member comprises a first pair of arms extending outwardly from the first abutment face of the first body component, the arms being received in a first recess formed in the second abutment face of the second body component; and the second non-threaded interlocking member comprises:

a rod extending within a second recess formed in the second body component, the second recess being in communication with the first recess;

a second pair of arms formed on the rod, the second arms releasably engaging the first arms; and a biasing member seated within the second recess and biasing an end of the rod such that the first and second pairs of arms are pressed into engagement with one another.

34. The iron type golf club of claim 33, wherein the biasing member is a spring.

* * * * *